United States Patent [19]

Domen et al.

[11] Patent Number: 4,465,173

[45] Date of Patent: Aug. 14, 1984

[54] COIN SELECTOR

[75] Inventors: Toshinori Domen; Fumio Masuda, both of Kawasaki, Japan

[73] Assignee: Fuji Electric Co., Ltd., Japan

[21] Appl. No.: 272,066

[22] Filed: Jun. 9, 1981

[30] Foreign Application Priority Data

Jun. 11, 1980 [JP] Japan ..... 55-77700

[51] Int. Cl.[3] ..... G07D 5/08

[52] U.S. Cl. ..... 194/100 A; 194/1 D; 194/1 K

[58] Field of Search ..... 194/1 K, 1 E, 1 P, 101, 194/100 R, 100 A, 1 C, 1 D, 99, 102; 133/3 D

[56] References Cited

U.S. PATENT DOCUMENTS

| | | | |
|---|---|---|---|
| 1,931,579 | 10/1933 | Gilchrist et al. | 194/100 R |
| 2,253,194 | 8/1941 | Nixon | 194/100 A |
| 4,089,400 | 5/1978 | Gregory | 194/99 X |
| 4,286,703 | 9/1981 | Schuller et al. | 194/1 K X |

FOREIGN PATENT DOCUMENTS

| | | | |
|---|---|---|---|
| 1381278 | 1/1975 | United Kingdom | 194/100 A |

*Primary Examiner*—F. J. Bartuska
*Attorney, Agent, or Firm*—Rogers, Eilers & Howell

[57] ABSTRACT

In a coin selector having a coin rail interposed between a main plate and a bracket, a true coin chute and a false coin chute disposed in parallel on the downstream side of the coin rail, a coin judging section for judging whether a coin moving along the coin rail is true or false and a gate lever driven by a command issued from the coin judging section to selectively guide the inserted coin to the true or false coin chute, the main plate has an opening disposed on the downstream side of the coin rail, the true coin chute is mounted on one surface of the main plate and the false coin chute is mounted on the other surface of the main plate in a manner that one end of the false coin chute is adjacent to the opening, so that the false coin moving down along the coin rail is guided into the false coin chute through the opening by the gate lever. A large clearance is not required between the coin rail and the false coin chute and it is not necessary to provide a wide distance between the false and true coin chutes, so that the length of the change tube provided under the coin selector is increased to accommodate an increased number of changes.

8 Claims, 3 Drawing Figures

COIN SELECTOR

BACKGROUND OF THE INVENTION

The present invention relates to a coin selector in use for automatic vending machines, and more particularly to improvements of the coin selector.

A prior coin selector for automatic vending machines is provided with a mechanism for judging whether a coin inserted from a coin slot and guided along a coin rail is true or false and another mechanism for selectively guiding the coin thus judged into a corresponding coin chute, i.e., a true coin chute or a false coin chute by controlling a gate lever. The false coin so judged is guided from a distal end of the coin rail to the false coin chute by the gate lever. Therefore, between the coin rail and the false coin chute, there must be provided a clearance to be determined so as to allow the passage of a false coin which would have the maximum diameter. The presence of the clearance hinders reduction of a height of the coin selector, and restricts a height of a change tube disposed in the lower part of the coin selector. This results in that the change tube is capable of containing an insufficient amount of change coin.

SUMMARY OF THE INVENTION

Accordingly, an object of the present invention is to provide a coin selector which improves a gate lever and a false coin chute to reduce a height of the coin selector, whereby an amount of change coins contained in a so-called coin mechanism is increased.

According to the present invention, there is provided a coin selector having a coil rail interposed between a main plate and a bracket, a true coin chute and a false coin chute which are arranged in parallel on the downstream side of the coin rail, a coin judging section for judging whether a coin moving along the coin rail is true or false, and a gate lever driven by a command issued from the coin judging section to selectively guide the inserted coin to the true coin chute or the false coin chute, wherein the main plate has an opening disposed on the downstream side of the coin rail, and the true coin chute is mounted on one surface of the main plate and the false coin chute is mounted on the other surface of the main plate in a manner that one end of the false coin chute is disposed closely to the opening, so that the false coin moving down along the coin rail is led to the false coin chute through the opening by the gate lever.

In a preferred embodiment of this invention, the true coin chute is interposed between the main plate and the bracket and the false coin chute is disposed on the outer surface of the main plate. The opening has a lower surface which is slanted downwardly and outwardly. The gate lever has an upper surface upon which the inserted coin is to impinge and which is slanted downwardly and outwardly like the lower surface of the opening.

Adjacent to the coin rail, there is provided a coin judging section which judges whether the inserted coin is true or false to produce a command of this judging result. The command is supplied to a solenoid for driving the gate lever. The gate lever is retracted to allow the true coin to fall on the true coin chute when the coin judging section judges that the inserted coin is true, while the gate lever is protruded to guide the false coin to fall on said false coin chute via the opening when the coin judging section judges that the inserted coin is false.

Preferably, a change tube is disposed on the downstream side of the true coin chute, and a return chute is disposed on the downstream side of the false coin chute.

The present invention will be better understood when carefully reading the following description taken in connection with the accompanying drawings, in which:

DESCRIPTION OF PREFERRED EMBODIMENTS

Figure 1:
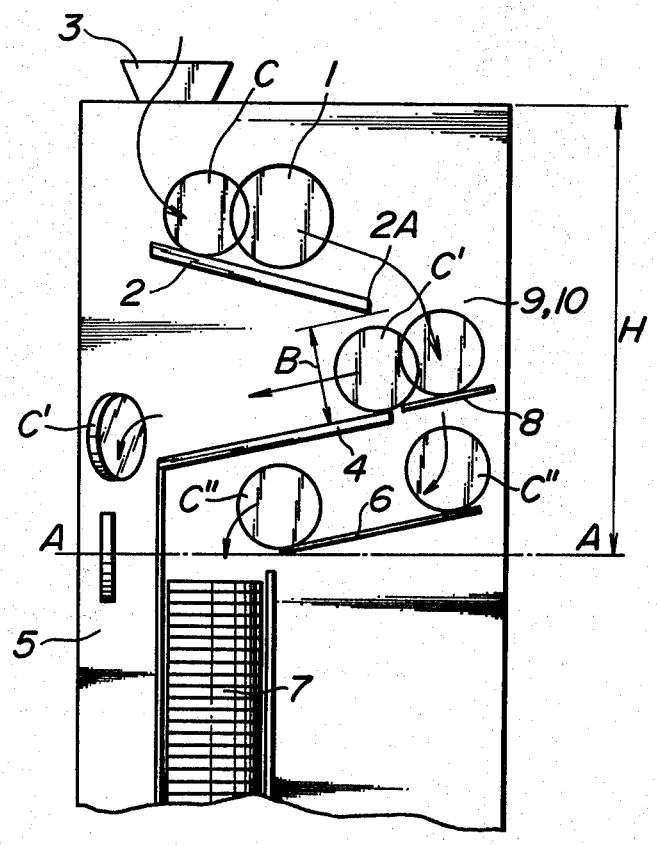
FIG. 1 PRIOR ART
FIG. 1 is a schematic diagram showing a prior coin selector and a change tube associated therewith.

First, an example of a prior coin selector is illustrated in FIG. 1. In the figure, a coin selector is located above line A—A and a change tube for containing change is located under the same line. Main portions of the coin selector are a judging section for judging whether an inserted coin is true or false, and a guide section for guiding the judged coin into a corresponding coin chute, i.e., a true coin chute or a false coin chute. In FIG. 1, reference numeral 1 designates the coin judging section which judges whether an inserted coin is true or false. A coin rail 2 is disposed slanted on which a coin C inserted from a coin slot 3 rolls down. In the course of the rolling of the coin, the coin C passes the coin judging section 1, while the surface of the rolling coin faces the side face of the coin judging section 1. A false coin chute 4 guides only a false coin C′ so judged to a return chute 5. The true coin chute 6 guides only a true coin C″ to a change tube 7 disposed at the lower part of the coin selector. The false chute 4 and the true coin chute 6 are arranged in parallel and slanted respectively at an acute angle with respect the coin rail 2 on the downstream side of the coin rail 2. A gate lever 8 is located at a position where it receives the coin C and guides it to the false coin chute 4 or to the true coin chute 6 when the coin C, after rolling down along the coin rail 2 and passing the side face of the coin judging section 1, drops from an end portion 2A of the coin rail 2. The gate lever 8, which is driven by a solenoid (not shown) operable in response to a command issued from the coin judging section 1, forms a passage continuous to the false coin chute 4 only when receiving a signal representative of the presence of the false coin C′ and breaks the passage when the coin C is the true coin C″, thereby allowing the true coin C″ to drop to the true coin chute 6.

When the coin judging section 1 detects the presence of the false coin C, the signal representing the presence of the false coin is transferred to the solenoid. Then, the solenoid drives the gate lever 8 to instantaneously form the passage at the location as mentioned above, so that the false coin C′ is guided to the false coin chute 4, not to the true coin chute 6 provided under the gate lever 8. When the coin C rolling down along the coin rail 2 is the true coin C″, the gate lever 8 is retracted from the passage continuous to the false coin chute 4 to thereby allow the true coin C″ to drop from the end portion 2A of the coin rail 2 to the true coin chute 6 and in turn to the change tube 7.

In the prior coin selector, however, the coin rail 2, the gate lever 8, the false coin chute 4, and the true coin chute 6 are sandwiched between the main plate 9 and the bracket 10. Here, in order to avoid an accident that the false coin C′ passing the false coin chute 4 after it drops from the end portion 2A into the gate lever 8, is held by the end portion 2A, a distance B between the lower end of the end portion 2A of the coin rail 2 and the upper surface of the false coin chute 4 must be selected to be slightly larger than the maximum diameter of the false coin C′ which would presumably be inserted into the coin slot 3. A distance between the false coin chute 4 and the true coin chute 6 must be wide enough to allow a free rolling of the true coin C″. For this reason, reduction of a height H of the coin selector is restricted. This fact also restricts a height of the change tube 7 located under the coin selector, and results in an insufficient amount of change coin contained in the change tube 7.

Figure 2A:
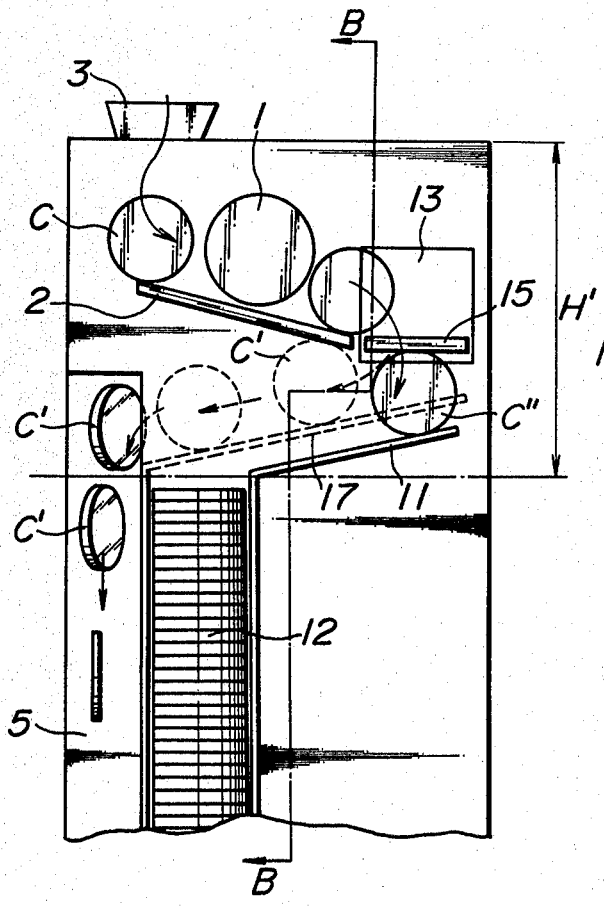
FIG. 2A is a schemitic diagram showing an embodiment of a coin selector according to the present invention and a change tube associated therewith.
Figure 2B:
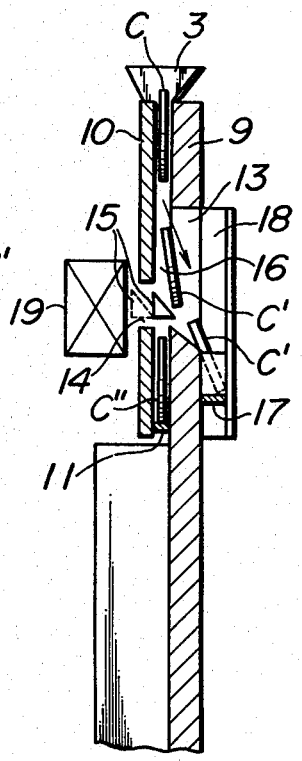
FIG. 2B is a cross sectional view taken along line B—B in FIG. 2A.

Accordingly, the present invention is proposed to solve the just-mentioned problem, and an embodiment of the present invention is illustrated in FIGS. 2A and 2B. The same reference numerals as in FIG. 1 are used in FIGS. 2A and 2B to designate like portions in FIG. 1, and the detailed explanations corresponding thereto are omitted.

In FIGS. 2A and 2B, the true coin chute 11 is located at substantially the same position as that where the false coin chute 4 is located in FIG. 1. Disposed under the lower end of the true coin chute 11 is a change tube 12. The main plate 9 has an opening 13 on the downstream side of the coin rail 2. The lower face partially defining the opening 13 is slanted downwardly and outwardly, as shown in FIG. 2B. Reference numeral 14 designates an opening formed in the bracket 10. An upper surface of a gate lever 15 upon which the inserted false coin C′ is to impinge is slanted downwardly and outwardly like the lower face of the opening 13. The gate lever 15 is horizontally movable such that the gate lever 15 is entirely retracted within the opening 14 of the bracket 10 to allow the true coin C″ to fall on the true coin chute 11, as indicated by a broken line in FIG. 2B, or is protruded to interrupt the lower part of a coin chute 16, i.e., to inhibit the false coin C′ to fall on the true coin chute 11, as indicated by a solid line in FIG. 2B. With the slanted face, the false coin C′ rolling down along the coin rail 2 is guided to the opening 13, when the gate lever 15 is protruded as shown by a solid line in FIG. 2B. A false coin chute 17 is provided on the other or reverse side surface 18 of the main plate 9 opposite to one surface or inner surface of the main plate 9 having the coin chute 16. The false coin chute 17 is disposed slightly above but substantially in parallel with the true coin chute 11, as shown FIG. 2A. A solenoid 19 for controlling the movement of the gate lever 15 operates in responce to a command from the coil judging section 1. More specifically, the coin judging section 1 controls the solenoid 19 by its judging result that the inserted coin C is the truc coin C″ or the false coin C′. The solenoid 19, when thus controlled, pushes out or attracts the gate lever 15.

When the coin C is inserted from the coin slot 3 into the coin selector thus constructed, the coin C rolls downwardly along the coin rail 2 to pass the side face of the coin judging section 1. When the coin judging section 1 judges that the coin C is a false coin, it issues to the solenoid 19 a command representative of the presence of the false coin. Upon receipt of the command, the solenoid 19 operates to push the gate lever 15 into the coin chute 16, so that the false coin C′ is introduced into the false coin chute 17 provided on the reverse side 18 of the main plate 9, along the slanted faces of the gate lever 15 and the opening 13. Then, the false coin C′ is further led from the false coin chute 17 to the return chute 5. On the other hand, when the coin judging section 1 judges that the coin C is a true coin, the solenoid 19 responds to the command of the true coin to retract the gate lever 15 into the opening 14. As a result, the true coin C″ directly drops along the coin chute 16 to roll downwardly along the true coin chute 11 and finally to reach the change tube 12.

As described above, in the present invention, the false coin chute 17 is provided on the reverse side of the main plate 9, communicating with the true coin chute 11 through the opening 13 of the main plate 9. The coin C judged to be a false coin is guided into the false coin chute 17 through the opening 13 by the gate lever 15 driven by the solenoid 19. With this arrangement, there is no need for a large clearance between the coin rail 2 and the false coin chute 17, unlike the prior art coin selector. Further, it is not necessary to provide a wide distance between the false coin chute 17 and the true coin chute 11. Therefore, the height of the coin selector can be reduced from H in FIG. 1 to H′ in FIG. 2A, so that the number of changes accommodated in the change tube 12 provided in the lower portion of the selector is increased to such an extent.

What is claimed is:

1. A compact coin selector comprising a coin rail interposed between one surface of a main plate and a bracket and inclined downwardly, a true coin rail which is arranged on said one surface of said main plate and has the starting portion therefor on the downstream side of said coin rail in a manner that said true coin rail extends downwardly in a direction reverse to the extending direction of said coin rail, a false coin rail which is arranged on the other surface of said main plate and has the starting portion thereof on the downstream side of said coin rail in a manner that said false coin rail also extends downwardly in a direction reverse to the extending direction of said coin rail, a coin judging section for judging whether a coin moving along said coin rail is true or false, a gate lever controlled by a command issued from said coin judging section to selectively determine movement of the inserted coin to said true coin rail or to said false coin rail, an opening provided in said main plate adjacent said gate lever and disposed on the downstream side of said coin rail, a coin reservoir which is provided on said one surface of said main plate and is disposed below and, at least in part, coplanar with said coin rail and which is displaced laterally from said opening, and a return chute which communicates with said other surface of said main plate in a manner that said return chute receives coins judged to be false and guided laterally away from said opening by said false coin rail, said true coin rail having said starting portion thereof just a short distance below the level of said opening to intercept true coins immediately after they move downwardly past said opening, said true coin rail inclining downwardly from said opening and toward said coin reservoir to guide true coins away from said opening and toward said coin reservoir, said true coin rail being, at least in part, coplanar with said coin rail, said starting portion of said false coin rail receiving false coins directed through said opening by said gate lever and then guiding said false coins away from said opening and toward said return chute, said false coin rail being mounted so said starting portion thereof is adjacent to said opening so each false coin moving down along said coin rail is led to said false coin rail through said opening by said gate lever and then is led to said return chute by said false coin rail.

2. A coin selector as claimed in claim 1, wherein said true coin rail is interposed between said main plate and said bracket, wherein said true coin rail and said false coin rail are at different levels, wherein said opening has a lower edge which is intermediate a path followed by true coins passing from said coin rail past said opening to said true coin rail and a different path followed by false coins passing from said coin rail through said opening to said false coin rail, wherein said gate lever has all portions thereof displaced from said opening whenever said coin judging section judges a coin on said coin rail to be a true coin, and wherein said gate lever blocks said path followed by true coins and has a portion thereof extending into said opening to overlie said lower edge of said opening to keep coins from striking said lower edge whenever said coin judging section judges a coin on said coin rail to be a false coin.

3. A coin selector as claimed in claim 1, wherein said opening has a lower surface which is slanted downwardly and outwardly to facilitate movement of false coins through said opening and onto said false coin rail to roll toward said return chute, wherein said gate lever has an upper surface upon which each false coin is to impinge and which is slanted downwardly and outwardly to facilitate movement of false coins into and through said opening, and wherein the lower part of said upper surface of said gate lever overlies the upper edge of said lower surface of said opening, and thereby keeps coins from striking said upper edge whenever said coin judging section judges a coin on said coin rail to be a false coin.

4. A coin selector as claimed in claim 1, wherein said gate lever has an upper surface upon which each false coin is to impinge and which is slanted downwardly and outwardly to facilitate movement of false coins into and through said opening and onto said false coin rail to roll toward said return chute, and wherein the lower surface of said gate lever is disposed far enough above the level of the upper edge of the lower surface of said opening to cause a plane, which is defined by said lower surface of said opening, to intersect said lower surface of said gate lever whenever said coin judging section judges a coin on said coin rail to be a false coin.

5. A coin selector as claimed in claim 1, wherein said gate lever is controlled by a solenoid to which said command from said coin judging section is supplied in a manner that said gate lever is retracted to allow the true coin to fall on said true coin rail when said coin judging section judges that the inserted coin is true and that said gate lever is protruded to guide the false coin to fall on said false coin rail via said opening when said coin judging section judges that the inserted coin is false, said opening having a lower edge which is intermediate a path followed by true coins passing from said coin rail past said opening to said true coin rail and a path followed by false coins passing from said coin rail through said opening to said false coin rail, said gate lever having a portion thereof extending into said opening to overlie said lower edge of said opening to keep false or true coins from striking said lower edge whenever said coin judging section judges a coin on said coin rail to be a false coin.

6. A compact coin selector having a coin rail interposed between a main plate and a bracket, a true coin rail and a false coin rail which are arranged on the downstream side of said coin rail, a coin judging section for judging whether a coin moving along said coin rail is true or false, a gate lever controlled by a command issued from said coin judging section to selectively determine movement of the inserted coin to said true coin rail or to said false coin rail, said coin selector comprising an opening provided in said main plate and disposed on the downstream side of said coin rail, a coin reservoir mounted adjacent the downstream end of said true coin rail and immediately adjacent one surface of said main plate and laterally displaced from said opening, said coin reservoir being disposed below and, at least in part, coplanar with said coin rail, said true coin rail being mounted on said one surface of said main plate to guide true coins away from said opening and toward said coin reservoir, said true coin rail being disposed below and, at least in part, coplanar with said coin rail, said false coin rail being mounted on the other surface of said main plate to guide false coins away from said opening and toward a false coin area which is displaced laterally from said opening and being mounted in a manner that one end of said false coin rail is adjacent to said opening, so that the false coin moving down along said coin rail is led to said false coin rail through said opening by said gate lever, and said false coin rail being disposed below the level of said coin rail so the vertical distance between the lower end of said coin rail and the level of the portion of said false coin rail which receives false coins passing through said opening is less than the diameter of one of said false coins.

7. A coin selector as claimed in claim 6 wherein said true coin rail is disposed below the level of said false coin rail, and wherein said true coin rail is disposed far enough below said coin rail so the vertical distance between the lower end of said coin rail and the level of the portion of said true coin rail along which true coins will roll as they move directly beneath said lower end of said coin rail, after said true coins move from said coin rail and past said opening, is slightly greater than, but close to, the diameter of one of said true coins.

8. A coin selector as claim in claim 6 wherein part of said true coin rail is disposed directly beneath, and directly in registry with, said coin rail so true coins which reach said true coin rail must thereafter roll beneath said coin rail, and wherein the vertical distance between the lower end of said coin rail and the portion of said true coin rail which receives true coins falling from said coin rail is greater than, but is close to, the diameter of one of said true coins, and wherein the vertical distance between a portion of the upper end of said coin reservoir and the corresponding portion of said coin rail is less than twice the diameter of a true coin.

* * * * *